US011297920B2

(12) United States Patent
Royce

(10) Patent No.: US 11,297,920 B2
(45) Date of Patent: Apr. 12, 2022

(54) BEVERAGE CARRYING SYSTEM

(71) Applicant: Roxanne Royce, Boulder, CO (US)

(72) Inventor: Roxanne Royce, Boulder, CO (US)

( * ) Notice: Subject to any disclaimer, the term of this patent is extended or adjusted under 35 U.S.C. 154(b) by 15 days.

(21) Appl. No.: 16/477,988

(22) PCT Filed: Jan. 18, 2018

(86) PCT No.: PCT/US2018/014142
§ 371 (c)(1),
(2) Date: Jul. 15, 2019

(87) PCT Pub. No.: WO2018/136586
PCT Pub. Date: Jul. 26, 2018

(65) Prior Publication Data

US 2020/0121048 A1 Apr. 23, 2020

Related U.S. Application Data

(60) Provisional application No. 62/499,139, filed on Jan. 18, 2017.

(51) Int. Cl.
*A45C 13/02* (2006.01)
*A45C 11/20* (2006.01)
(Continued)

(52) U.S. Cl.
CPC ..... *A45C 11/20* (2013.01); *A45C 13/02* (2013.01); *B65D 71/50* (2013.01); *B65D 81/3825* (2013.01)

(58) Field of Classification Search
CPC ... A45C 2013/026; A45C 11/20; A45C 13/02; B65D 71/50; B65D 81/3825
(Continued)

(56) References Cited

U.S. PATENT DOCUMENTS 3,365,092 A * 1/1968 Nam ..... A47J 41/0055 220/23.88
3,401,535 A 9/1968 Palmer
(Continued)

OTHER PUBLICATIONS

Royce International, Insulated Beverage Carrier—'BevBag' (Red), www.amazon.com/Insulated-Beverage-Carrier-BevBag-Red//dp/B01LJFEMB0, Jul. 16, 2016, entire document.
(Continued)

*Primary Examiner* — Steven A. Reynolds
(74) *Attorney, Agent, or Firm* — David Guerra

(57) ABSTRACT

Beverage-carrying devices and apparatus are described herein. In various embodiments, a beverage-carrying apparatus may include: an insulated outer container comprising a bottom wall, one or more side walls extending perpendicularly from a perimeter of the bottom wall such that an interior with an open top is defined by the one or more side walls and the bottom wall, and a top wall that is securable to one or more edges of one or more of the side walls opposite the bottom wall to close the open top; a handle secured to the top wall; and a beverage tray positioned within the interior of the insulated outer container, the beverage tray comprising one or more cup holders that are accessible through the open top. In various embodiments, each of the one or more cup holders may include one or more inwardly biased components to snugly receive an inserted beverage container.

19 Claims, 4 Drawing Sheets

(51) Int. Cl.
*B65D 71/50* (2006.01)
*B65D 81/38* (2006.01)

(58) Field of Classification Search
USPC ..... 220/592.24, 592.16, 592.03, 592.23, 220/592.09
See application file for complete search history.

(56) References Cited

U.S. PATENT DOCUMENTS 4,809,352 A 2/1989 Walker
4,916,923 A 4/1990 Adams et al.
5,313,807 A * 5/1994 Owen ..... B65D 81/3886 62/372
5,421,172 A 6/1995 Jones
6,513,661 B1 * 2/2003 Mogil ..... A45C 3/00 150/106
6,644,063 B2 * 11/2003 Mogil ..... A45C 7/0077 383/110
7,162,890 B2 * 1/2007 Mogil ..... A45C 11/20 62/457.7
7,344,028 B2 3/2008 Hanson
8,348,087 B2 * 1/2013 Sawaki ..... B65D 81/3855 220/592.2
8,607,984 B2 * 12/2013 Breton ..... B65D 1/36 206/563
2010/0059199 A1 * 3/2010 Court ..... B60N 2/5607 165/46
2016/0101924 A1 4/2016 Mitchell et al.

OTHER PUBLICATIONS

4Imprint, Koozie Square Kooler, web.archive.org/web/20150721055447/http://www.4imprint.com:80/product/128016/KOOZIE-Square-Kooler, Jul. 21, 2015, entire document.
Yodo, Yodo 24-can Soft Sided Cooler Lunch Bag—Insulated up to 4 Hours—Lightweight idea for Beach, Picnics, Road Trip, Everyday Lunch to Work or School, www.amazon.com/Yodo-24-can-Sided-Cooler-Lunch/dp/B015MH27WE>, Mar. 28, 2016, entire document.

* cited by examiner

BEVERAGE CARRYING SYSTEM

CROSS-REFERENCE TO RELATED APPLICATIONS

This application is an U.S. national phase application under 35 U.S.C. § 371 based upon co-pending International Application No. PCT/US2018/014142 filed on Jan. 18, 2018. Additionally, this U.S. national phase application claims the benefit of priority of co-pending International Application No. PCT/US2018/014142 filed on Jan. 18, 2018, which claims priority to U.S. Provisional Application No. 62/499,139 filed on Jan. 18, 2017. The entire disclosures of the prior applications are incorporated herein by reference. The international application was published on Jul. 26, 2018 under Publication No. WO 2018/136586 A1.

STATEMENT REGARDING PRIOR DISCLOSURES BY THE INVENTOR OR A JOINT INVENTOR

The following disclosures are submitted under 35 U.S.C. 102(b)(1)(B):

A "grace period disclosure" was published on Jul. 16, 2016 by ROYCE INTERNATIONAL. This publication was entitled "Insulated Beverage Carrier—'BevBag' (Red)" and published at www.amazon.com/Inusulated-Beverage-Carrier-BevBag-Red/dpB01LJFEMB0. ROYCE INTERNATIONAL obtained the subject matter directly from the applicant not more than one year before the effective filing date of the claimed present technology. The applicant is a co-author of this publication.

BACKGROUND

It can be difficult for customers to carry more than one beverage from a beverage service facility, especially when the beverage liquid is extremely hot or extremely cold. Customers often attempt to hold the drink cups individually, frequently resulting in spills. Beverage facilities, take-out restaurants, and sports arenas often provide a cardboard tray for carrying two or more beverages. However carrying a tray of beverages, especially beverages of different sizes or contents, can cause the customer difficulty in stability and balance when carrying the tray, resulting in tipping of the cups and spilling of the contents of the drink cups. This is even more problematic when the customer does not have both hands free such as when the other hand is carrying food, laptops, bags, etc. . .

Another problem the aforementioned trays present is that they are exposed to the outside air. Consequently, if the beverages are hot (e.g., coffee, tea) they may become cool if left in the tray too long. Similarly if the beverages are cold (e.g., soda, beer, milkshakes, etc.), they may warm up if left in the tray too long.

Another potential hazard arises when the beverage is not kept level, e.g., when placed in the seat of a vehicle. If the beverage tray is tilted too far from level, the shifting weight of the beverages may lead to spillage. This problem can be exacerbated when the beverage tray is not fully loaded. For example, beverages commonly come with four cup holders in a two-by-two arrangement. If less than four beverage trays are secured in the tray, and especially if two beverages are secured on one side of the tray and the other two trays are left empty, the entire tray can become unstable. Additionally, no matter how many beverages it holds, a two-by-two beverage requires two hands to carry.

Portable containers for beverages with handles have been used occasionally. Containers of this type do not securely support beverages that are susceptible to spillage. The most popular containers have rigid plastic bodies, but are not enclosed and are exposed to the elements and thus do not retain their temperature over a short period of time. Other containers which are enclosed do not secure the drinks in place. They rely on internal dividers which allow food and beverages to shift and reposition, such that beverages which are not completely sealed spill and leak within the container. Such containers can often be expensive and/or difficult to manufacture.

SUMMARY

Embodiments of the present disclosure include a drink carrier, which may also be referred to as a beverage bag or "beverage carrying apparatus." According to some embodiments, the carrier is designed to carry cups full of liquid. Drinks may be secured with a tray of one or more securing devices at the bottom of the carrier. In various embodiments, the beverage carrying device may include, e.g., at the bottom of its interior, a relatively rigid beverage tray with one or more cup holders. In some embodiments, the cup holders may be designed to snugly and securely receive beverage containers so that when the device is carried, the beverages are stably contained within. In various embodiments, a beverage carrying device may be closeable and insulated to maintain temperature(s) of one or more beverages inserted therein. According to some embodiments, food can be placed within the carrier, in addition to the securing device and drinks.

In some embodiments, a beverage-carrying apparatus may include: an insulated outer container comprising a bottom wall, one or more side walls extending perpendicularly from a perimeter of the bottom wall such that an interior with an open top is defined by the one or more side walls and the bottom wall, and a top wall that is securable to one or more edges of one or more of the side walls opposite the bottom wall to close the open top; a handle secured to the top wall; and a beverage tray positioned within the interior of the insulated outer container, the beverage tray comprising one or more cup holders that are accessible through the open top. In various embodiments, each of the one or more cup holders may include one or more inwardly biased components to snugly receive an inserted beverage container.

In various embodiments, the beverage tray may have an outer perimeter that substantially corresponds to a shape of the bottom wall such that the beverage tray is snugly secured into a bottom of the interior of the insulated outer container. In various embodiments, the one or more cup holders may take the form of four cup holders in a two-by-two arrangement. In various embodiments, the bottom wall may have a square shape that approximately corresponds to an outer perimeter of the beverage tray. In various embodiments, the one or more side walls may include four walls, with each of the four walls arranged at a right angle relative to two other walls of the four walls. In various embodiments, the insulated outer container may have a height of between eight and nine inches and a width of between eight and nine inches. According to some embodiments, the insulated outer container includes an outside pouch adapted to carry items, for example, condiments such as cream and sugar. According to some embodiments, the outside pouch may be configured to carry accouterments, napkins, and/or other items.

In various embodiments, the bottom wall, the one or more side walls, and the top wall may be constructed with flexible insulated material. In various embodiments, the apparatus may further include one or more reinforcing bands constructed with material that is more rigid than the flexible insulated material. In various embodiments, one or more of the reinforcing bands may extend across the top wall. In various embodiments, one or more of the reinforcing bands may extend across the bottom wall.

In various embodiments, the beverage tray may be constructed with material that is more rigid than the flexible insulated material. In various embodiments, the apparatus may further include one or more pouches secured on one or more exteriors of one or more of the walls. In various embodiments, the bottom wall, the one or more walls, and the top wall may include insulating foam. In various embodiments, faces of the bottom wall, the one or more walls, and the top wall that face the interior of the insulated outer container may include aluminum. In various embodiments, the insulated outer container may be leak-proof. In various embodiments, the top wall may be securable to the one or more edges of one or more of the side walls using a zipper.

While multiple embodiments are disclosed, still other embodiments of the present disclosure will become apparent to those skilled in the art from the following detailed description, which shows and describes illustrative embodiments of the invention. Accordingly, the drawings and detailed description are to be regarded as illustrative in nature and not restrictive.

BRIEF DESCRIPTION OF THE DRAWINGS

In order that the embodiments may be better understood, embodiments of the disclosure will now be described by way of examples. These embodiments are not to limit the scope of the claims as other embodiments of the disclosure will become apparent to one having ordinary skill in the art upon reading the present description. Non-limiting examples of the present embodiments are shown in figures wherein:

DETAILED DESCRIPTION

Figure 1:
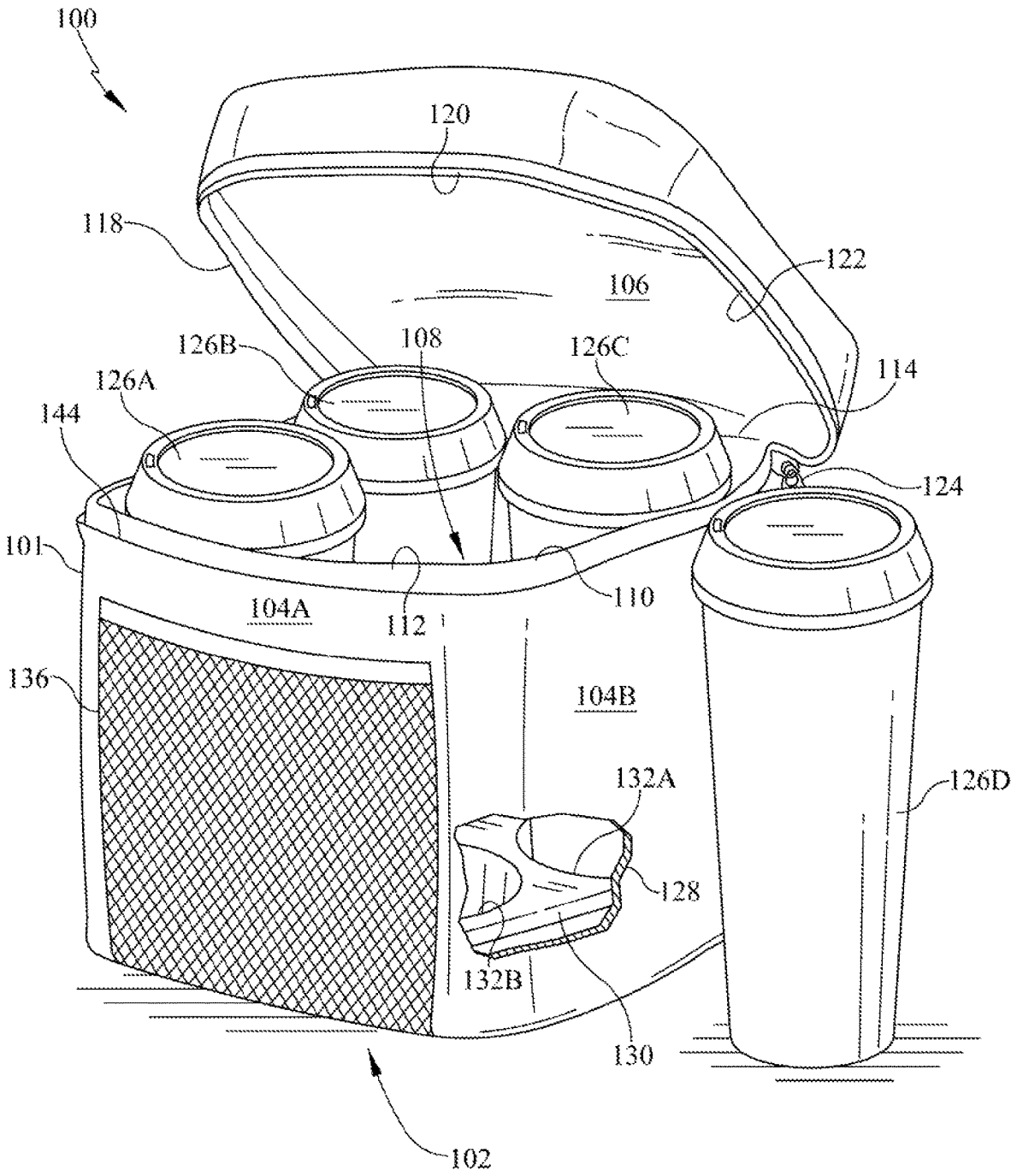
FIG. 1 depicts a perspective view of a beverage carrying apparatus in an open configuration, in accordance with various embodiments.

It is to be understood that the embodiments of beverage carrying devices and apparatus described herein are not limited in their application to the details of construction and the arrangement of components set forth in the following description or illustrated in the drawings. Other embodiments are capable of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," coupled," and "mounted," and variations thereof herein are used broadly and encompass direct and indirect connections, couplings, and mountings. In addition, the terms "connected" and "coupled" and variations thereof are not restricted to physical or mechanical connections or couplings.

FIG. 1 depicts a perspective view of a beverage carrying apparatus 100 in an open configuration, in accordance with various embodiments. Beverage carrying apparatus 100 may include an insulated outer container 101. Insulated outer container 101 may include a bottom wall 102, one or more side walls 104, and a top wall 106. In preferred embodiments, such as the embodiment of FIG. 1, there are four side walls 104, two (104A and 104B) that are fully visible. These four walls may define a rectangular and/or square footprint. However, this is not meant to be limiting, and in various embodiments, other numbers of walls may be included, such as one wall (in which case beverage carrying apparatus 100 would have a circular or elliptical footprint), three walls (in which case beverage carrying apparatus 100 would have a triangular footprint), and so forth. In various embodiments, the one or more side walls 104 may extend perpendicularly from a perimeter of bottom wall 102 such that an interior 108 with an open top 110 is defined by the one or more side walls 104 and bottom wall 102.

In various embodiments, top wall 106 may be securable to one or more edges 112 of one or more side walls 104 opposite bottom wall 102 to close open top 110. Various mechanisms may be used to secure top wall 106 to edges 112 of one or more side walls 104. In the embodiment depicted in FIG. 1, one edge 114 of top wall 106 is integral with a side wall, and the other three edges 118, 120, and 122 are free. In some embodiments, such as that depicted in FIG. 1, top wall 106 may be secured to side walls 104 to close open top 110 by way of a zipper 124. In other embodiments, other mechanisms may be used, such as hook-and-loop fasteners, belts, snaps, buttons, magnets, drawstrings, and so forth.

Insulated outer container 101 may be constructed with various materials. In some embodiments, insulated outer container 101 is constructed with various textiles and/or other materials (e.g., nylon) that may include multiple layers. In some such embodiments, one or more layers of the multiple layers may include insulating material, such as insulating foam. Accordingly, insulated outer container 101 may be relatively flexible, and in some cases may be collapsible when empty. In some embodiments, one or more of walls 102-106 may be relatively rigid compared to others. For example, in some embodiments, bottom wall 102 may be constructed to be more rigid than side walls 104 and/or top wall 106. In some embodiments, faces of walls 102-106 facing interior 108 may be constructed with (e.g., coated with) aluminum or other similar material to increase the temperature-retaining properties of insulated outer container 101.

In FIG. 1, three beverages 126A-C, which happen to take the shape of coffee cups with tops, are inserted into interior 108. A fourth beverage 126D is depicted outside of insulated outer container 101, but could also be inserted into insulated outer container 101. A cut-out portion 128 of insulated outer container 101 is included for illustrative purposes to depict a portion of a beverage tray 130 contained in interior 108 of insulated outer container 101. Two cup holders 132A and 132B are visible through cut out portion 128, one 132A holding third beverage 126C and the other 132B left empty. Cup holders 132A and 132B are accessible through open top 110 so that a person can insert beverages (126) into cup holders (132) and close top wall 106, thereby containing the beverages within beverage carrying apparatus 100. Due to the insulated nature of insulated outer container 101, beverages contained in beverage carrying apparatus 100 are able to retain their temperature (heat, cold) for a longer period of time than if they were carried in the open.

In the embodiment of FIG. 1, beverage carrying apparatus 100 includes an optional outer pouch 136 secured to one of the side walls 104. This pouch may be used to carry various items, such as sugar packets, condiments, creamer packets, napkins, wipes, snacks, ice packs, portable heaters, etc. In this example, pouch 136 is constructed with flexible netting, but this is not meant to be limiting. In various embodiments, one or more outer pouches may be constructed differently, e.g., with other materials, nylon, etc. In some embodiments, pouches may be spill and/or leak proof, and/or themselves may be constructed with insulating material so that they retain the temperature(s) of their contents.

Figure 2:
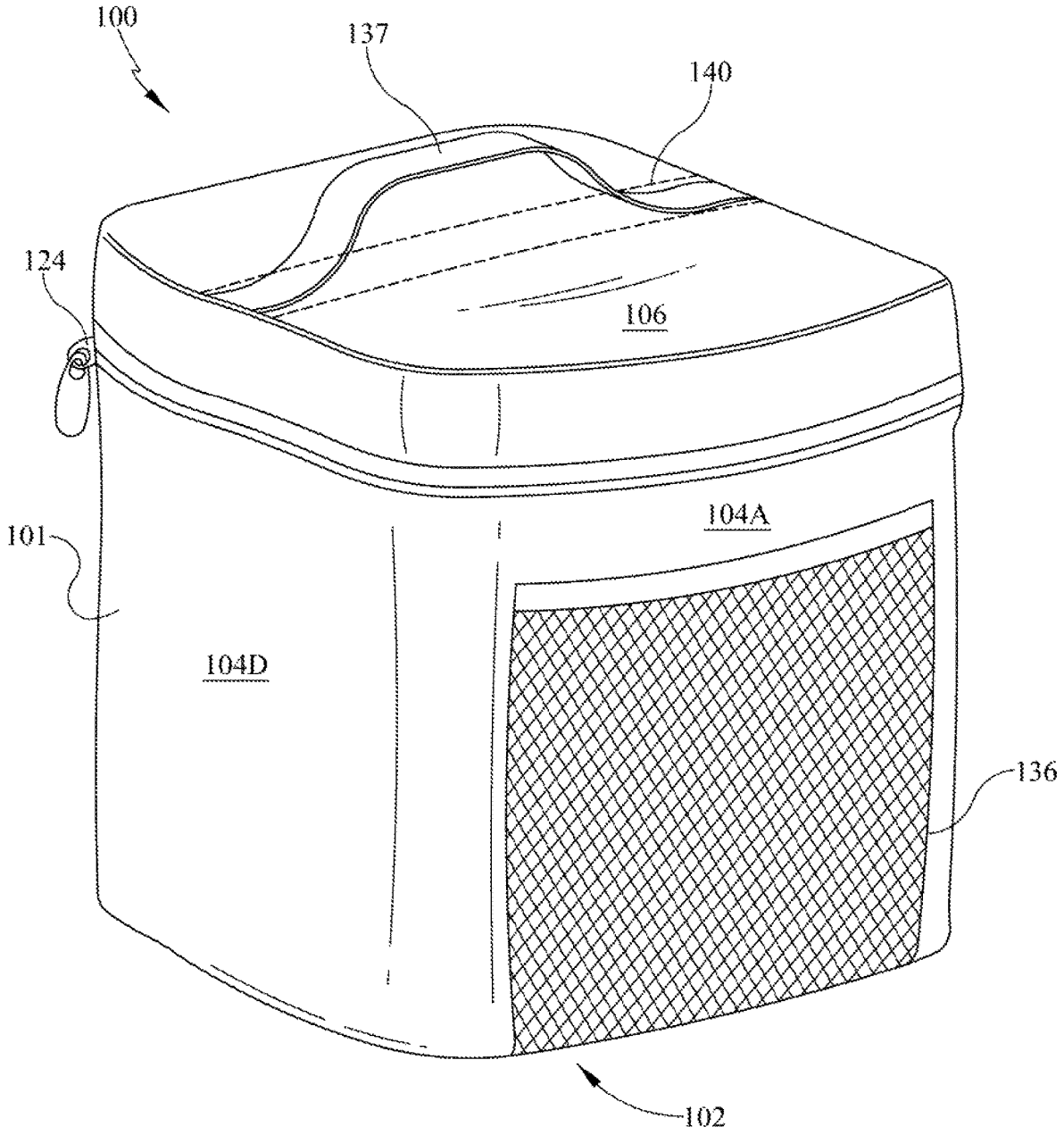
FIG. 2 depicts a perspective view of a beverage carrying apparatus in a closed configuration, in accordance with various embodiments.

FIG. 2 depicts the beverage carrying apparatus 100 of FIG. 1 in a closed configuration in which zipper 124 has been operated to secure the entire perimeter of top wall 106 to the entire perimeter defined by walls 104A-D. A handle 137 is visible secured to top wall 106 (e.g., with stitching, staples, glue, button(s), etc.). When top wall 106 is closed, handle 137 may be grasped by a person to carry beverage carrying apparatus 100 without fear of it tipping over. To this end, in some embodiments, handle 137 may be secured at a position such that when grasped, the person's hand is aligned with a center of gravity of beverage carrying apparatus 100. In some embodiments, such as that depicted in FIG. 2, handle 137 extends across a width of top wall 106. However, this is not meant to be limiting. In various embodiments, handle 137 may extend in other ways across top wall 106, such as across its length, or even diagonally. Moreover, while only one handle 137 is depicted, this is not meant to be limiting. In various embodiments, multiple handles may be positioned on one or more walls of insulated outer container 101, such as on one or more side walls 104, bottom wall 102, etc.

Also depicted in FIG. 2 (using dashed lines) is a reinforcing band 140 that is constructed with material (e.g., rope, more rigid nylon, metal or plastic strip, etc.) that is more rigid than the flexible insulated material used to construct insulated outer container 101. In this example, reinforcing band 140 extends across a middle of top wall 106. However, this is not meant to be limiting. In various embodiments, one or more additional reinforcing bands may extend across top wall 106 and/or across any other walls, such as bottom wall 102 and/or one or more of side walls 104A-D. Reinforcing band 140 may be sewn on top of top wall 106 (or any other wall), between layers of top wall 106, etc. In some embodiments, insulated outer container 101 and one or more reinforcing bands 140 may be constructed with the same material, except that reinforcing band(s) 140 may be woven to be more durable, e.g., as multiple layers. Additionally or alternatively, in some embodiments, insulated outer container 101 and reinforcing band(s) 140 may be constructed with different materials. For example, reinforcing band may be constructed with a rope-like material.

Figure 3:
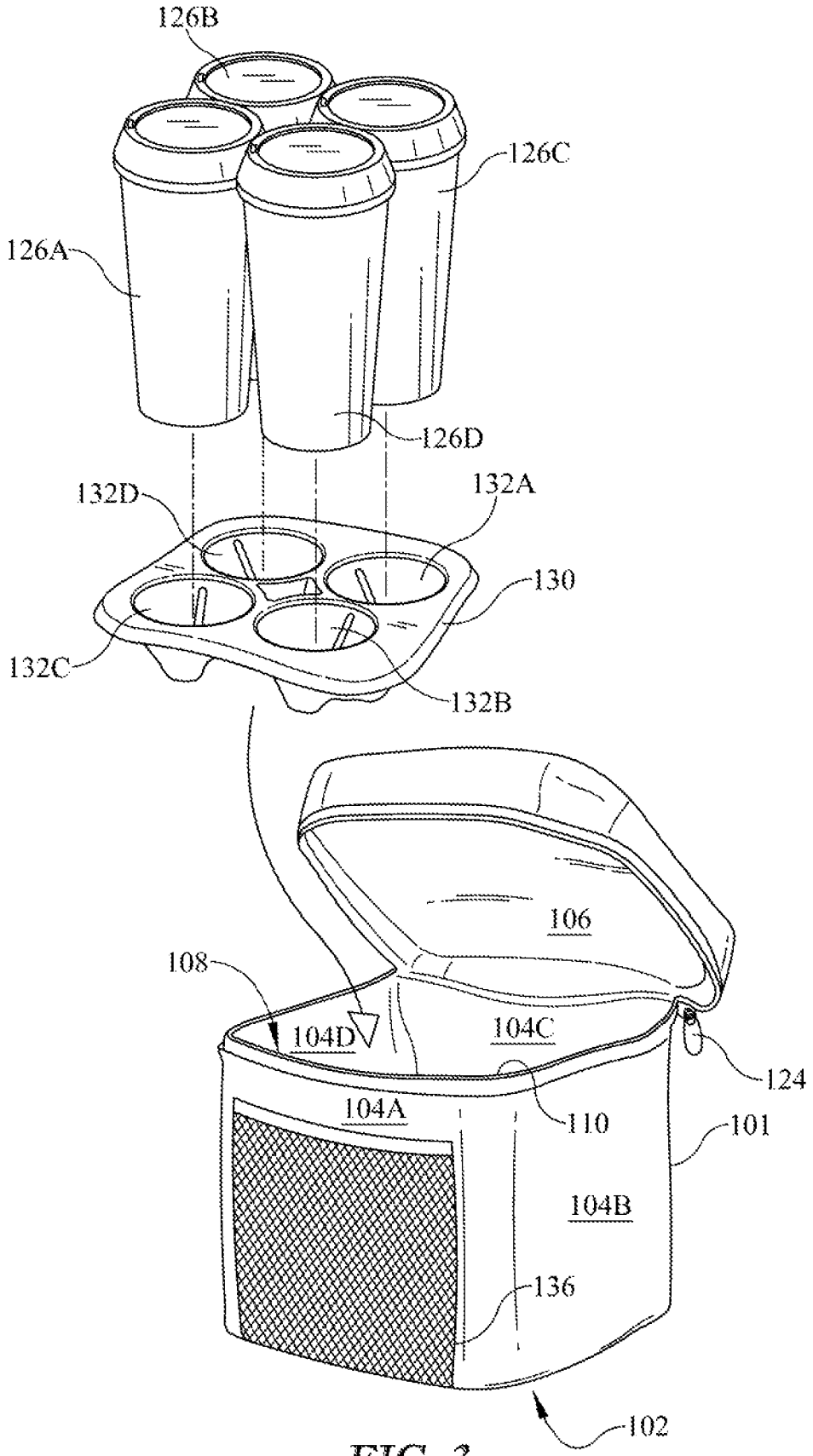
FIG. 3 depicts an exploded view of a beverage carrying apparatus, in accordance with various embodiments.

FIG. 3 is an exploded view showing how a plurality of beverages 126-D may be secured within a plurality of cup holders 132A-D of a beverage tray 130. FIG. 3 also depicts how beverage tray 130 may be positioned within interior 108 of insulated outer container 101 such that cup holders 132A-D are accessible through open top 110. In various embodiments, beverage tray 130 may be a distinct component that may be snugly inserted into a bottom of interior 108 of insulated outer container 101. To this end, in some embodiments, beverage tray 130 may include dimensions (e.g., a footprint) that correspond approximately to dimensions (e.g., a footprint) of insulated outer container 101. For example, in some embodiments, beverage tray 130 may have a footprint that is between approximately eight and nine inches on each side (e.g., length and width). Accordingly, insulated outer container 101 may also have a footprint with a length between approximately eight and nine inches (e.g., 8.25") and a height between approximately eight and nine inches (e.g., 8.25"). In various embodiments, insulated outer container 101 may have a height that is selected to accommodate most standard beverages when top wall 106 is closed. For example, in some embodiments, insulated outer container 101 may have a height between approximately eight and nine inches, such as 8.25".

Figure 4:
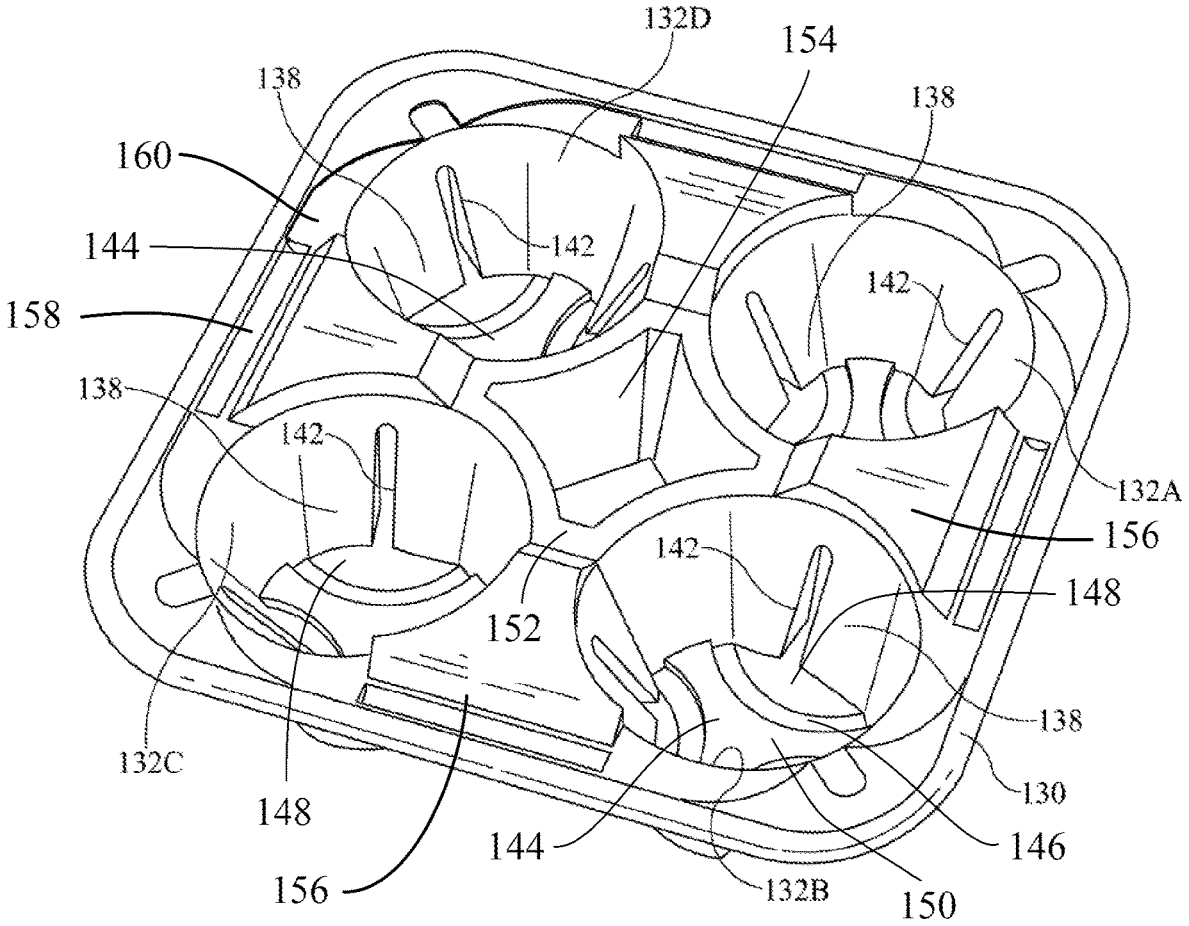
FIG. 4 is a perspective view of a beverage tray for use with a beverage carrying apparatus configured with selected aspects of the present disclosure.

FIG. 4 depicts one example of a beverage tray 130 that may be used with various embodiments of the present disclosure. While in examples described herein, beverage tray 130 has been depicted as having four cup holders 132A-D in a two-by-two arrangement, this is not meant to be limiting. In various embodiments beverage trays having other numbers and/or arrangements of cup holders may be employed. When those beverage trays have different foot prints than beverage tray 130, then insulated outer container 101 may be constructed to fit those other footprints. Moreover, in some embodiments, beverage tray 130 may be removably and snugly inserted into a bottom of interior 108 of insulated outer container 101. However, in other embodiments, beverage tray 130 may be integral with outer insulated container 101, and may or may not be constructed with similar materials.

In various embodiments, beverage tray 130 may be constructed with material that is rigid enough to support four beverages filled with fluid, without beverage tray 130 collapsing under their weight. In some embodiments, beverage tray 130 may be constructed with cardboard, such as recycled cardboard. In other embodiments, beverage tray 130 may be constructed with other materials, such as plastic, firm rubber, metal, wood, rope-like material, etc. In some embodiments, beverage tray 130 may include components other than cup holders, such as receptacles for items such as snacks, medicine, etc.

In various embodiments, one or more of cup holders 132 may include various structures that arc designed to ensure that when a beverage 126 is inserted, it is snugly, stably, and/or forcefully held within cup holder 132. This may reduce the chances that beverage 126 will fall out of cup holder 132. For example, in FIG. 4, each cup holder 132A-D includes one or more inwardly biased components 138, such as inwardly biased walls, that are designed to snugly receive an inserted beverage container. In some embodiments, one or mere slots 142 may be defined between one or more inwardly biased components 138, e.g., to allow inwardly biased components 138 room to maneuver against their inherent bias when a beverage is inserted. The one or more slots 142 may each extend along the wall 138 of the inwardly biased components and into a base 144 of the cup holders 132A-D.

The base 144 of the cup holders 132A-D can each include a first section 146 and a second section 150. The first section 146 can define an opened space 148 in the base that is in communication with at least one of the slots 142. The second section 150 can be adjacent the first section 146, and can have a height greater than a height of the first section 146 extending into an interior of the cup holders 132A-D.

The tray 130 can further include a middle section 152 at least partially between the one or more cup holders 132A-D, where the middle section 152 can include inwardly extending concave sidewalls or ridges 154 configured to provide rigidity to the tray 130.

The tray 130 can further include elevated structures 156 associated with an upper surface of the tray 130 which encompasses the pockets or cup holders 132A-D and wherein the slots 142 may extend into the elevated structures 156. The elevated structures 156 can have an angled or arcuate edge that transitions to the middle section 152. Adjacent to an edge of each of the elevated structures 156 can be a recessed ridge 158 defined in the upper surface of the tray 130. The recessed ridge 158 can be configured to provide rigidity to the tray 130 and/or to be grasped by a hand of a user.

The tray 130 can further include support gussets 160 that can connect or transition each of the cup holders 132A-D to the upper surface of the tray 130 by sloping walls and the height of the support gussets 160 are lower than the upper surface of the tray 130.

In addition to insulated outer container 101 being insulated and/or including materials like aluminum on its inner face, other measures may be taken to maintain temperatures of beverages inserted into beverage carrying apparatus 100. For example, and referring back to FIG. 1, in some embodiments, insulated outer container 101 may be constructed with multiple layers. In some such embodiments, spaces between these layers, such as indicated at 144 in FIG. 1, may be accessible. Accordingly, it is possible to insert components such as ice packs, heat packs, or even battery-operated ice/heat packs into these spaces.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification, unless clearly indicated to the contrary, should be understood to mean "at least one."

The phrase "and/or," as used herein in the specification, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of," or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of."

As used herein in the specification, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

What is claimed is:

1. A beverage carrying system comprising:

an insulated outer container comprising:

a bottom wall;

one or more side walls extending perpendicularly from a perimeter of the bottom wall such that an interior with an open top is defined by the one or more side walls and the bottom wall, the one or more side walls each including multiple layers defining a space between the layers;

a top wall that is securable to one or more edges of one or more of an inner layer of the multiples layers of the one or more side walls opposite the bottom wall to close the open top;

a handle secured to the top wall; and wherein the space being configured to be accessible when the top wall is in a closed position, and being configured to receive one or more ice packs or one or more heat packs;

a beverage tray positionable within the interior of the insulated outer container, the beverage tray comprising:

one or more cup holders that are accessible through the open top;

a support gusset on opposite sides of each of the one or more cup holders configured to connect each of the one or more cup holders to an upper surface of the beverage tray by sloping walls;

a recessed ridge defined in the upper surface of the beverage tray, the recessed ridge extending between the support gusset for each of the one or more cup holders that are opposingly arranged, wherein a height of the support gusset being lower than the upper surface of the beverage tray;

wherein the gusset extends from a side wall of the tray connecting the recessed ridge and a support shoulder located at each corner of the tray;

wherein the beverage tray includes one or more slots defined between the inwardly biased components, the one or more slots being configured to allow maneuvering of the inwardly biased components, respectively, against an inherent bias of the inwardly biased components when the beverage container is inserted into the cup holders, respectively; and wherein each of the one or more cup holders includes one or more inwardly biased components configured to receive a beverage container inserted in at least one of the cup holders.

2. The beverage carrying system of claim 1, wherein the beverage tray has an outer perimeter that substantially corresponds to a shape of the bottom wall such that the beverage tray is secured into a bottom of the interior of the insulated outer container.

3. The beverage carrying system of claim 1, wherein the one or more slots each extend along a wall of the inwardly biased components and into a base of the cup holders, respectively.

4. The beverage carrying system of claim 3, wherein the base of the cup holders each includes a first section defining an opened space in the base that is in communication with at least one of the one or more slots, and a second section adjacent the first section, wherein the first section has a first height extending into an interior of the cup holders, and the second section has a second height greater than the first height and extending into the interior of the cup holders.

5. The beverage carrying system of claim 1, wherein the bottom wall, the one or more side walls, and the top wall are constructed with flexible insulated material.

6. The beverage carrying system of claim 5, further comprising one or more reinforcing bands constructed with material that is more rigid than the flexible insulated material.

7. The beverage carrying system of claim 6, wherein one or more of the one or more reinforcing bands extend across at least one of the top wall or the bottom wall.

8. The beverage carrying system of claim 7, wherein the one or more reinforcing bands are sewn on an exterior of the top wall or between at least one of multiple layers of the top wall at a location directly between the handle the top wall.

9. The beverage carrying system of claim 1, wherein the bottom wall and the top wall each include multiple layers, and wherein one or more layers of the multiple layers of the bottom wall, the one or more side walls and the top wall includes insulating foam.

10. The beverage carrying system of claim 1, wherein the bottom wall and the top wall each include multiple layers defining a second space between the layers, wherein the second space is configured to be accessible.

11. The beverage carrying system of claim 1, further comprising one or more pouches secured on one or more exteriors of one or more of the one or more side walls, wherein the pouches are constructed of a material selected from the group consisting of netting, nylon, and insulated material.

12. The beverage carrying system of claim 1, wherein faces of the bottom wall, the one or more side walls, and the top wall that face the interior of the insulated outer container include aluminum.

13. A beverage carrying system comprising:

an insulated outer container comprising a bottom wall, one or more side walls extending perpendicularly from a perimeter of the bottom wall such that an interior with an open top is defined by the one or more side walls and the bottom wall, and a top wall that is securable to one or more edges of one or more of the one or more side walls opposite the bottom wall to close the open top; and a tray comprising:

one or more cup holders configured to receive at least a portion of a beverage container, each of the one or more cup holders includes one or more inwardly biased components configured to receive and provide a biasing force to the beverage container inserted in at least one of the cup holders, the inwardly biased components includes one or more slots defined therein, the one or more slots being configured to allow maneuvering of the inwardly biased components, respectively, against an inherent bias of the inwardly biased components when the beverage container is inserted into the cup holders, respectively;

a support gusset on opposite sides of each the one or more cup holders configured to connect each of the one or more cup holders to an upper surface of the tray by sloping walls, a height of the support gusset being lower than the upper surface of the tray; and a recessed ridge defined in the upper surface of the beverage tray, the recessed ridge being in communication with and between the support gusset for each of the one or more cup holders that are opposingly arranged;

wherein the support gusset extends from a side wall of the tray connecting the recessed ridge and a support shoulder located at each corner of the tray;

wherein the tray is configured to be received in the interior of the insulated outer container so that the one or more cup holders are accessible through the open top of the insulated outer container.

14. The beverage carrying system of claim 13, wherein the tray further comprising a middle section at least partially between the one or more cup holders, the middle section includes ridges configured to provide rigidity to the tray.

15. The beverage carrying system of claim 13, wherein the one or more side walls each including multiple layers defining a space between the layers, the space being configured to be accessible when the top wall is in a closed position, and being configured to receive one or more ice packs or one or more heat packs, and wherein the one or more cup holders are pockets.

16. The beverage carrying system of claim 13, wherein each of the cup holders includes a base including a first section adjacent to one of the one or more slots, and a second section adjacent the first section, wherein the first section has a first height extending into an interior of the cup holders, and the second section has a second height greater than the first height and extending into the interior of the cup holders.

17. The beverage carrying system of claim 16, wherein the first section of the base is at least three first sections each being adjacent to the second section.

18. The beverage carrying system of claim 16, wherein the first section of the base is arcuate and configured to define an opened space in the base that is in communication with at least one of the one or more slots, respectively.

19. The beverage carrying system of claim 13, wherein the one or more cup holders comprises at least four cup holders.

* * * * *